US006948531B2

(12) United States Patent
Hofstetter

(10) Patent No.: US 6,948,531 B2
(45) Date of Patent: Sep. 27, 2005

(54) GRIPPING COLLET FOR SEAM-WEAVING MACHINES

(75) Inventor: Edgar Hofstetter, Hohenstein (DE)

(73) Assignee: Wangner Finckh GmbH & Co. KG, Reutlingen (DE)

( * ) Notice: Subject to any disclaimer, the term of this patent is extended or adjusted under 35 U.S.C. 154(b) by 184 days.

(21) Appl. No.: 10/669,147

(22) Filed: Sep. 22, 2003

(65) Prior Publication Data

US 2004/0154678 A1 Aug. 12, 2004

Related U.S. Application Data

(63) Continuation-in-part of application No. PCT/EP02/03234, filed on Mar. 22, 2002.

(30) Foreign Application Priority Data

Mar. 23, 2001 (DE) ..... 201 05 091 U

(51) Int. Cl.[7] ..... D03D 47/20

(52) U.S. Cl. ..... 139/448; 139/383 AA; 139/447; 28/142

(58) Field of Search ..... 139/383 AA, 447, 139/448, 214; 242/541; 28/208, 142

(56) References Cited

U.S. PATENT DOCUMENTS

| | | | | |
|---|---|---|---|---|
| 3,315,709 A | * | 4/1967 | Svaty | 139/438 |
| 4,350,184 A | * | 9/1982 | Muller et al. | 139/448 |
| 4,410,015 A | | 10/1983 | Koller et al. | |
| 5,358,015 A | | 10/1994 | Hacker et al. | |
| 5,390,708 A | * | 2/1995 | Kuster et al. | 139/383 AA |
| 5,411,063 A | * | 5/1995 | Hacker et al. | 139/383 AA |
| 5,720,323 A | * | 2/1998 | Tremer | 139/446 |

FOREIGN PATENT DOCUMENTS

| | | |
|---|---|---|
| AT | 403700 B | 9/1997 |
| DE | 8122449.4 | 12/1982 |
| DE | 8713074.2 | 11/1988 |
| DE | 9002278.5 | 7/1991 |
| DE | 9211353.2 | 1/1994 |
| DE | 9215498.0 | 3/1994 |
| EP | 0043441 A1 | 1/1982 |
| EP | 0236601 A1 | 9/1987 |
| EP | 0 301174 A1 | 2/1989 |
| EP | 0586959 A1 | 3/1994 |
| EP | 0597494 A1 | 5/1994 |

OTHER PUBLICATIONS

Published PCT Application WO 02/077341 A1.
International Search Report.

* cited by examiner

*Primary Examiner*—John J. Calvert
*Assistant Examiner*—Robert H. Muromoto
(74) *Attorney, Agent, or Firm*—Graybeal Jackson Haley, LLP

(57) ABSTRACT

The gripping collet (10) for grasping a thread during the preparation of a woven seam is arranged at the end of a draw-through gripper and has a first and a second clamping element, the first and the second clamping element (20, 24) being able to be clamped against each other for grasping the thread using a pneumatic cylinder. The first clamping element has two cylinder surfaces (20) at a distance from each other and the second clamping element has one cylinder surface (24). The arrangement of the cylinder surfaces (20, 24) is such that the axes of the cylinder surfaces lie parallel to each other and essentially at right-angles to the axis of the pneumatic cylinder and, in the extended state of the pneumatic cylinder, the cylinder surface (24) of the second clamping element lies between the two cylinder surfaces (20) of the first clamping element.

5 Claims, 5 Drawing Sheets

GRIPPING COLLET FOR SEAM-WEAVING MACHINES

CROSS-REFERENCE TO RELATED APPLICATION

Figure 1:
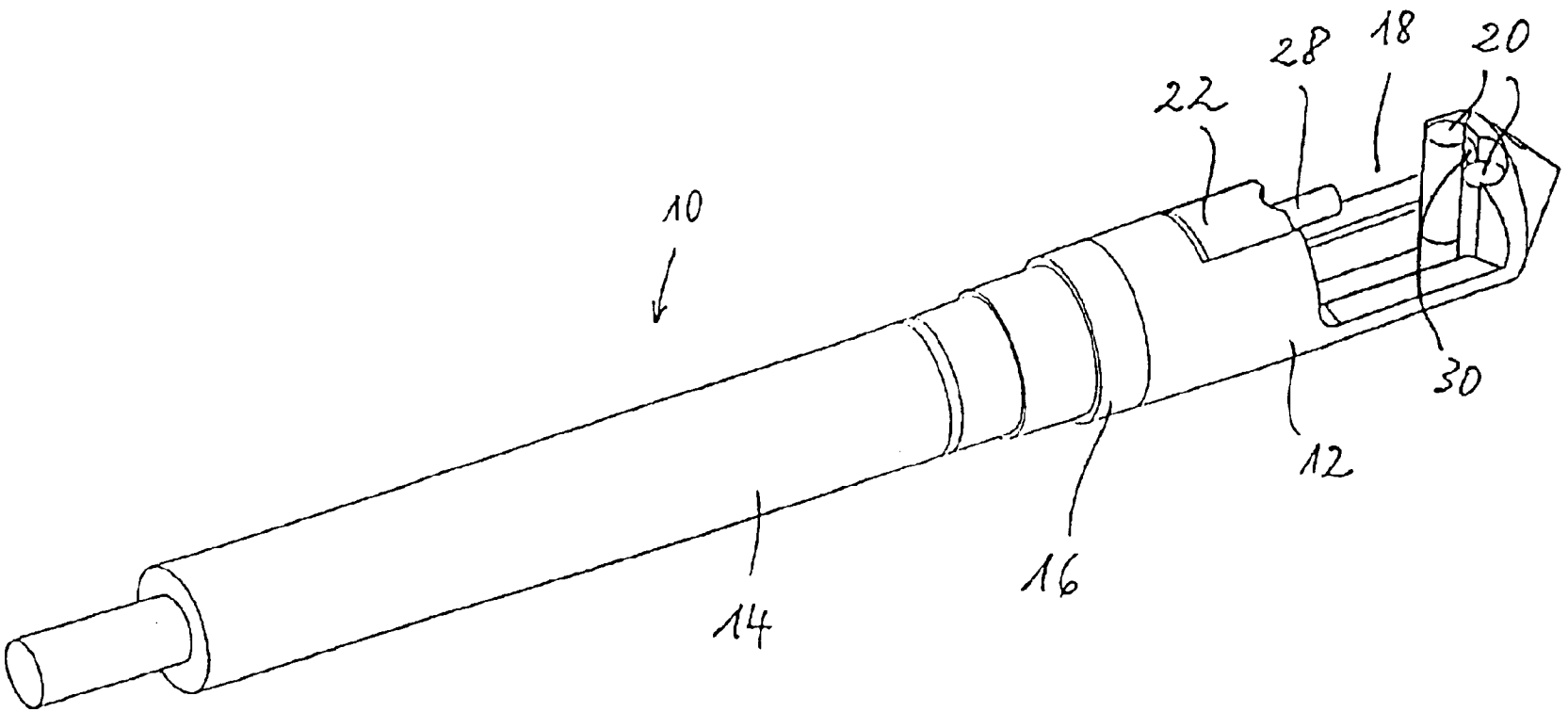

The applicant hereby claims benefit of PCT patent application No. PCT/EP02/03234, filed 22 Mar., 2002, and designating United States, which is incorporated by reference, of which this application is a continuation-in-part, and priority to German application No. 20105091.9 filed on 23 Mar., 2001.

Description

The invention relates to a gripping collet for grasping a thread. The gripping collet is arranged at the tip of a movable gripping arm of a draw-through gripper which serves to insert the thread, a so-called auxiliary weft thread, into the seam-weaving shed in a seam-weaving machine.

In paper manufacture, a drainage screen or sheet-forming fabric (forming fabric) is used to drain the paper web, which at first consists predominantly of water. The drainage screens consist of artificial monofilaments and are woven on wide weaving machines, then made continuous by a temporary seam and thermofixed on setting machines so that the crimps of the warp and weft threads are permanently impressed. Then the drainage screens are cut apart again and, in a final process step, sewn into an continuous screening cloth using a woven seam. The woven seam is an extremely sensitive and also time-consuming step in the preparation process of a drainage screen. In order to improve this time-consuming process, seam-weaving machines or sewing machines were developed.

To produce a woven seam, warp threads are exposed over a length of e.g. 15 cm to the woven fabric ends which are to be joined to each other, the weft threads in this zone being removed. The so-called woven seam, in which the original weave binding is exactly reproduced, is then formed from the resultant warp thread fringes and the weft threads removed from the woven fabric end. An auxiliary weaving shed or seam-weaving shed is spread out from the removed weft threads, in which the removed weft threads function as auxiliary warp threads. The warp thread fringes are inserted into this seam-weaving shed as auxiliary weft threads alternately from the two woven fabric ends. Of the numerous warp thread fringes projecting from every woven fabric end, one warp thread fringe is singled out and held fast by means of a separator (DE-U-87 13 074, EP-A-0 301 174 and DE-U-90 02 278). A transfer gripper transports this warp thread fringe to a draw-through gripper which then inserts it into the seam-weaving shed as an auxiliary weft thread, so that the auxiliary weft thread initially lies taut in the seam-weaving shed.

The draw-through gripper is of the design mentioned initially and is known e.g. from DE-U-81 22 449, EP-A-0 043 441 and EP-A-0 236 601. The presence of the warp thread fringe is no longer checked by the draw-through gripper.

During this process the auxiliary weft thread must be held at different tensions by the gripping collet which is integrated into the draw-through gripper. The gripping collet known from DE-U-92 15 498 (=EP-A-0 597 494) consists of a gripping collet body and a pressure element which is moved by a pneumatic cylinder. Between a flat clamping surface on the gripping collet body and a flat surface on the pressure element which are parallel to each other, the auxiliary weft thread is clamped with a corresponding pressure, produced by the pneumatic cylinder. When the auxiliary weft thread is pulled in through the seam-weaving shed the pneumatic cylinder is as a rule exposed to a higher pressure than during the subsequent rolling-on using the sley. This rolling-on is described in DE-U-92 11 353 (=EP-A-0 586 959).

New, more complex fabric designs require on the one hand a particularly high clamping force when pulling in and on the other hand a more sensitive, that means lower, clamping force when rolling in. This cannot always be achieved by the gripping collets with flat, parallel clamping surfaces, gripping collet counter body and at the pressure element.

The object of the invention is to create a gripping collet which can be controlled so that, on the one hand, it holds the thread secure so that a high tensile force can be exerted on the thread, and that, on the other hand, a very low clamping force can also be reproducibly measured out.

This object is achieved according to the invention in that the first clamping element has two cylinder surfaces at a distance from each other and that the second clamping element has a cylinder surface, the arrangement of the cylinder surfaces being such that the axes of the cylinder surfaces lie parallel to each other and essentially at right angles to the axis of the pneumatic cylinder and that, in the extended state of the pneumatic cylinder, the cylinder surface of the second clamping element lies between the two cylinder surfaces of the first clamping element.

In the case of the gripping collet according to the invention, a very high clamping force is achieved with a relatively small cylinder. This is achieved by means of three physical effects 1. by the deformation of the warp thread, the axis of the thread and the axis of the cylinder surfaces standing perpendicular to each other so that there is spot contact between the thread and the cylinder surfaces. Bearing in mind the deformability of the thread made of artificial material, e.g. polyester or polyamide, very small contact surfaces with a correspondingly high contact pressure result when clamping fast the threads between the clamping elements.
2. by the coefficient of friction and the resulting frictional force.
3. by the looping friction.

The extremely low and reproducible warp thread tension during rolling-on is achieved by a force balance, the gas pressure in the cylinder being reduced to the point where the force exerted on the piston by the gas pressure is roughly equal to the return force of the cylinder spring. A floating state of the piston of the pneumatic cylinder is thereby achieved, in which there is no substantial deformation of the thread and the frictional force is reduced. In this state the actual frictional force results from:

1. the coefficient of friction and the resulting frictional force.
2. The reduced looping friction.

An advantage of the gripping collet according to the invention is that it is largely insensitive to soiling. The clamping force is only insubstantially effected by adhering dirt.

Figure 2:
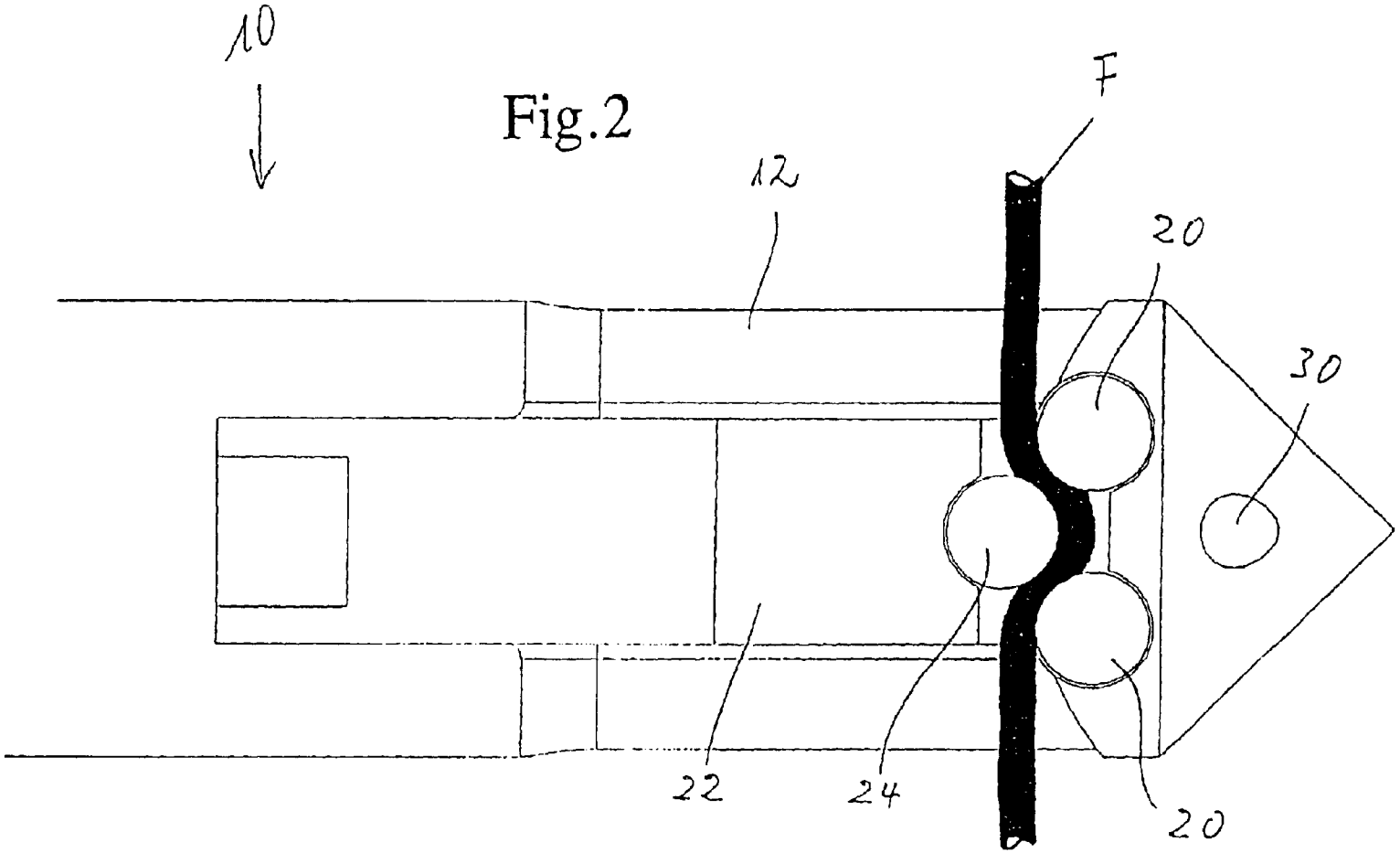
Figure 3:
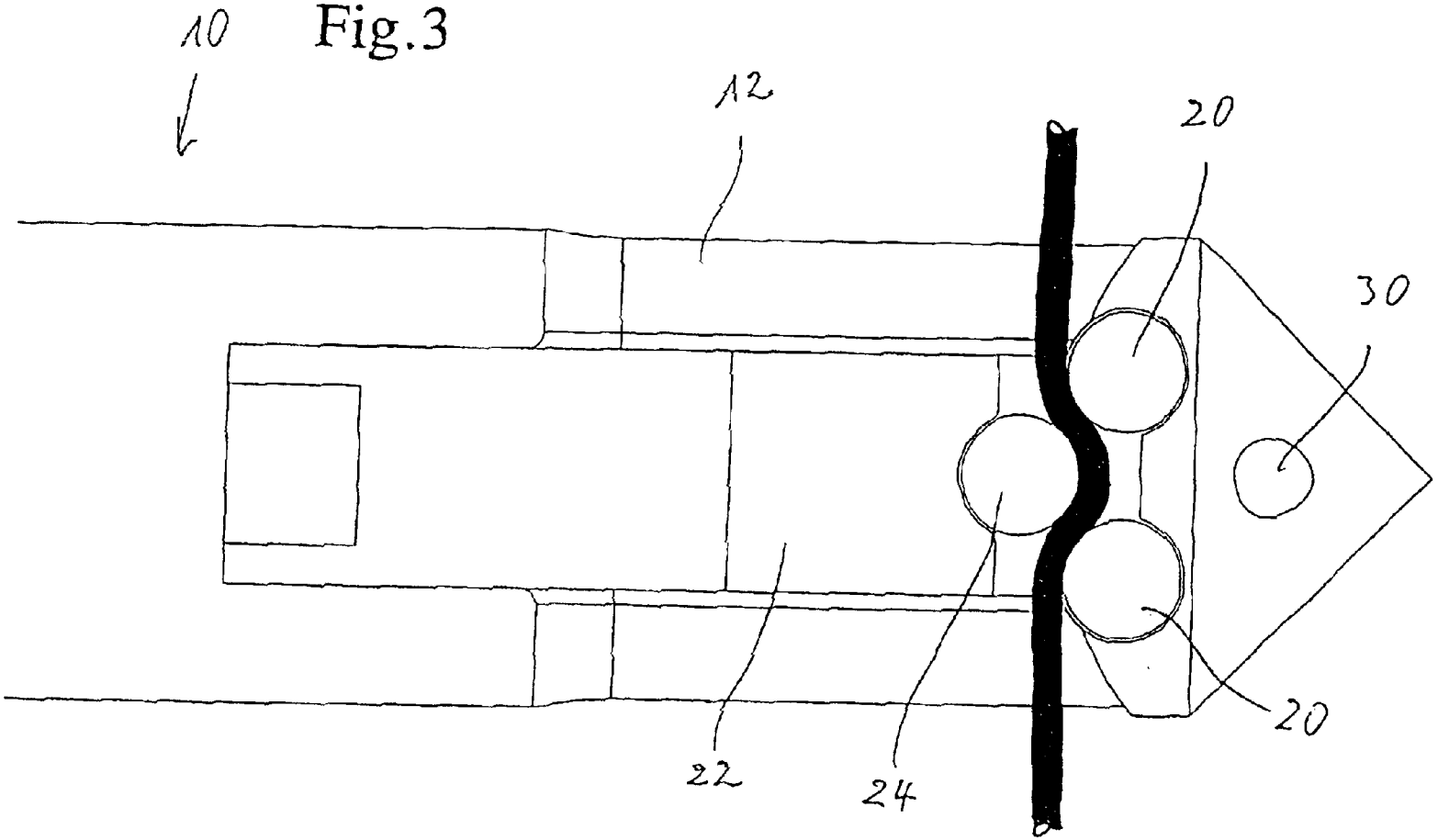
Figure 4:
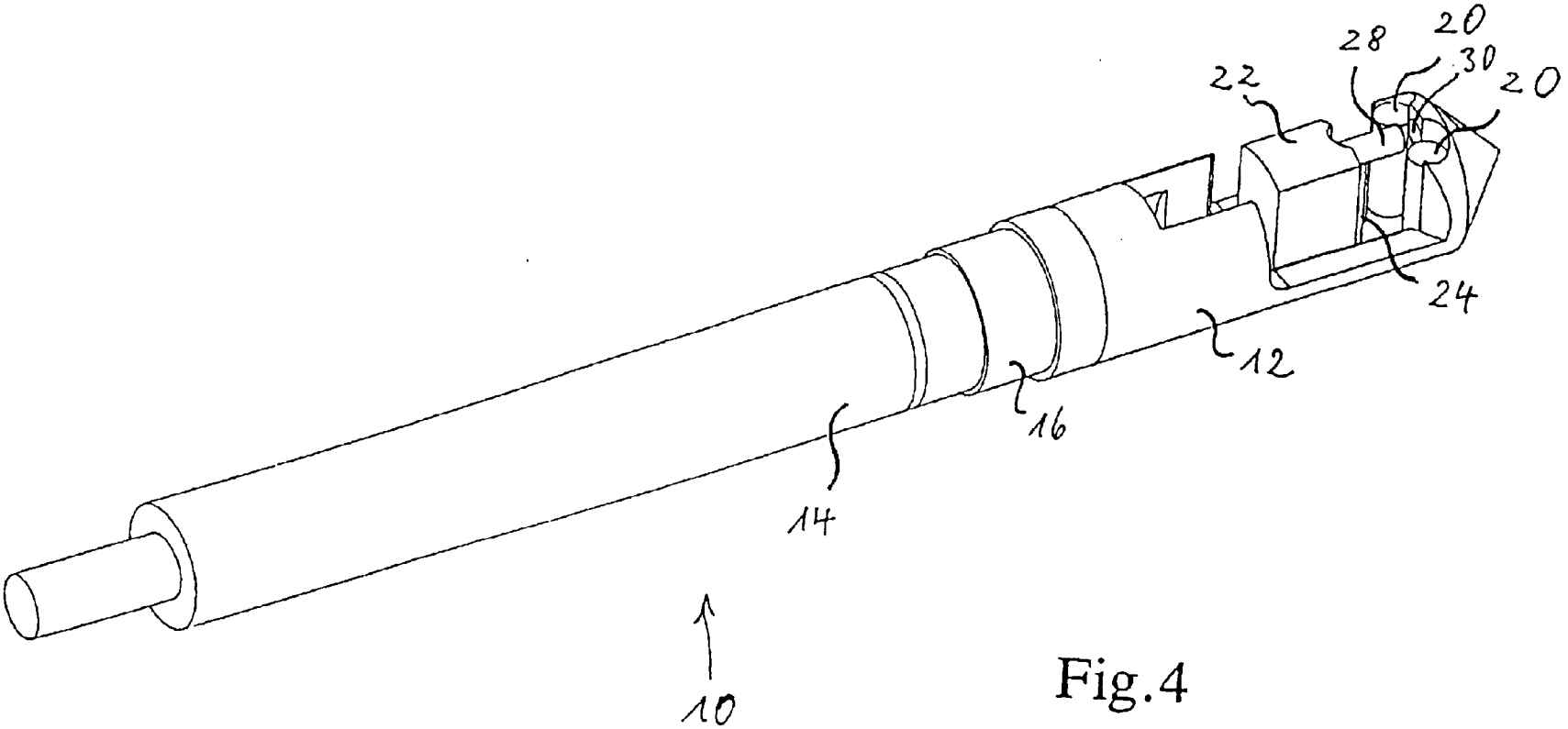
Figure 5:
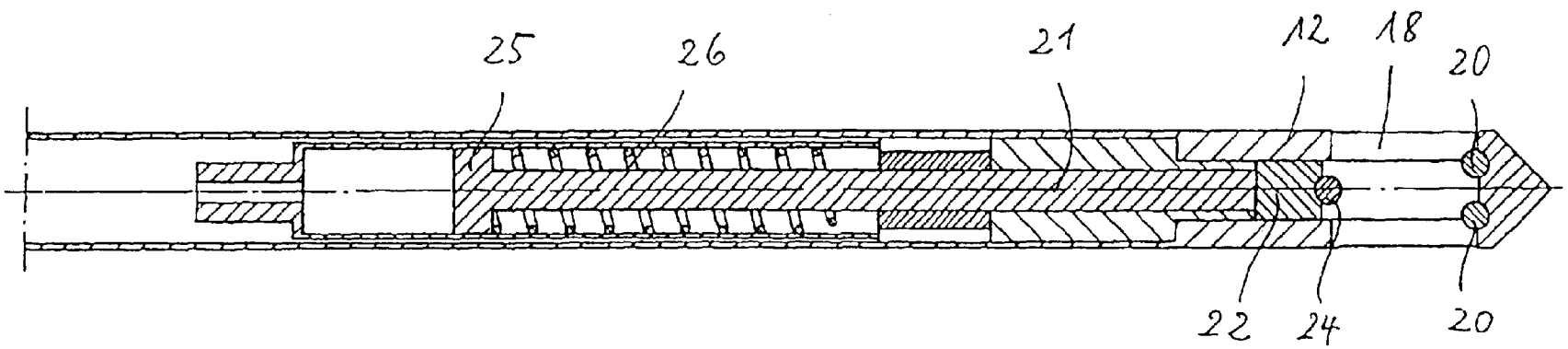

An embodiment of the invention is explained in the following using the drawing. There are shown in:

FIG. 1 the gripping collet in a three-dimensional representation;

FIG. 2 the gripping collet from above in closed position;

FIG. 3 the gripping collet in the position with reduced gas pressure in pneumatic cylinder (force balance);

FIG. 4 the gripping collet in a three-dimensional representation in partially closed position, but without thread and FIG. 5 the gripping collet in section.

The gripping collet 10 is cylindrical overall and is comprised of a clamping body 12 and a pneumatic cylinder 14, which are connected by means of an adapter ring 16.

The clamping body 12 has a transverse incision which forms a mouth 18. At the front end of the mouth two cylinder bodies 20 are embedded or arranged, the distance between which is roughly 70% of their diameter and the axes of which run at right-angles to the axis of the gripping collet 10, both cylinder bodies 20 being the same distance from this axis. The cylinder bodies 20 represent a first clamping element.

At the front end of a piston rod 21 of the pneumatic cylinder 14 a pressure element 22 is provided, in the end surface of which a further cylinder body 24 is embedded or arranged. The axis of the further cylinder body 24 likewise lies at right-angles to the axis of the gripping collet 10, this cylinder body 24 lying exactly on the axis of the gripping collet 10. The pressure element 22 is guided secure against rotation in the clamping body 12, so that the parallel alignment of the axes of the cylinder bodies 20, 24 is always guaranteed. The piston 25 is returned to the open position shown in FIGS. 1 and 5 by a return spring 26. The further cylinder body 24 represents a second clamping element.

The pressure element 22 with the further cylinder body 24 can be extended by means of the pneumatic cylinder 14 so that a thread F placed in the mouth 18 as shown in FIG. 2, is deformed between the cylinder bodies 20, 24 and thereby clamped fast, is held fast i.e. by clamping and deforming.

A pin 28 pointing in axial direction is furthermore fixed to the pressure element 22 over the further cylinder body 24 (not represented in FIG. 2 and FIG. 3), which, upon extension into a suitable bore 30, immerses at the tip of the clamping body 12 (FIG. 4). This pin 28 prevents a thread F held fast in the gripping collet 10 from becoming loose in radial direction from the gripping collet 10. The diameter of the pin 28 is slightly smaller than the distance between the cylinder bodies 20, so that the pin 28 can pass through between the two cylinder bodies 20.

The cylinder bodies 20, 24 are prepared from a hard, abrasion-resistant material, e.g. hard metal or ceramic. They are fixed to the clamping body 12 or to the pressure element 22 in suitable recesses. The cylinder bodies 20, 24 can also be integrated into the mould of the clamping body 12 or the pressure element 22. The clamping body 12 and the pressure element 22 are then prepared completely from the hard, abrasion-resistant material.

It is not essential for the invention that the first and second clamping elements are developed as complete cylinder bodies, but that the surfaces of the first and second clamping elements facing each other are curved about parallel axes.

The mode of operation of the gripping collet is explained in the following. The thread F, which is a warp thread fringe or so-called auxiliary weft thread, is placed in the normal way by a transfer gripper into the mouth 18 of the gripping collet 10. The pneumatic cylinder 14 is then exposed to pressure so that the further cylinder body 24 is moved towards the cylinder bodies 20 and the inserted thread F clamped between the cylinder bodies 20, 24, the thread being crimped or deformed as shown in FIG. 2. The cylinder bodies 20, 24 press into the thread F with their cylinder surfaces and impart to the thread a clamping force resulting from the frictional force and looping friction. The gripping collet forms the front end of a normal and thus non-represented draw-through gripper. After the thread F has been grasped the head of the draw-through gripper is moved through the seam-weaving shed so that the thread comes to lie in the seam-weaving shed as an auxiliary weft thread. The auxiliary weft thread is the fringe of a warp thread so that it possesses the wave shape permanently applied wave shape by the thermofixing mentioned at the start.

As the weaving shed is formed from auxiliary warp threads, i.e. from threads which have been singled out from the woven fabric to be made continuous, the auxiliary warp threads likewise have a wave shape permanently applied by the thermofixing. For the stability and the reliability of the woven seam it is essential that the wave shapes of the auxiliary weft threads and the auxiliary warp threads interlock according to the fabric pattern. A form locking thereby occurs which guarantees a very high strength of the woven seam. In order that the wave troughs and wave crests of the auxiliary weft threads and the auxiliary warp threads can interlock according to the fabric pattern, a very high tensile stress has to be applied to the auxiliary weft threads after being pulled through the weaving shed. This high tensile stress is produced by the draw-through gripper, to which end the auxiliary weft thread F has to be clamped as firmly as possible in the gripping collet 10.

After the auxiliary weft thread F is pulled into the weaving shed and a high tensile stress has built up in the auxiliary weft thread F, the auxiliary weft thread is rolled in using the sley. In order to ensure the form-locking engagement of the wave troughs and crests of the auxiliary weft thread between the auxiliary warp threads, the auxiliary weft thread is not simultaneously cast over the entire width of the weaving shed, but starting from the end of the woven fabric, from which it hangs as a warp fringe, in succession over the width of the weaving shed. This process is called "rolling-on". For the form-locking engagement of the wave shape of the auxiliary weft threads and the auxiliary warp threads the auxiliary weft thread has to be able to shorten its length during the rolling-on. Before rolling-on the pressure in the pneumatic cylinder 14 is reduced to the point where it roughly compensates the force of the return spring 26 (force balance). The pressure element 22 with the further cylinder body 24 is moved back somewhat through the thread F, which, after the reduction of the gas pressure in the pneumatic cylinder 14, is elastically relaxed in the direction of its diameter, as can be recognised in FIG. 3. Through the force balance between the gas pressure in the pneumatic cylinder and the force of the return spring 26 the pressure element 22 floats, i.e. it exerts a force in neither one nor the other direction and lies pressureless against the thread F. The auxiliary weft thread F is therefore still held only by the looping friction in the gripping collet 10 while it is rolled in from the sley along the fell.

It has been shown that the tensile stress occurring in the auxiliary weft thread is reproducible to a large extent, whereby the quality and uniformity of the prepared woven seam is improved.

The necessary chronological control of the pressure in the pneumatic cylinder 14 takes place in known way using signals which are derived from the seam-weaving machine control device.

List of Reference Numbers

10 gripping collet
12 clamping body
14 pneumatic cylinder
16 adapter ring
18 mouth
20 cylinder body (first clamping element)

21 piston rod
22 pressure element
24 further cylinder body (second clamping element)
25 piston
26 return spring
28 pin
30 bore

What is claimed is:

1. A Gripping collet, the gripping collet being adapted to be arranged at the end of a draw-through gripper for grasping a thread during the preparation of a woven seam, the gripping collet comprising:

a gripping collet body;

a pneumatic cylinder attached at the gripping collet body and including a piston which is extendable and retractable along an axis;

a first clamping element having two cylinder surfaces arranged at a distance from each other, the axes of the cylinder surfaces being arranged parallel to each other and substantially at right-angles to the axis of the pneumatic cylinder; and a second clamping element having a cylinder surface, the axis of the cylinder surface being arranged parallel to the axes of the cylinder surfaces of the first clamping element and substantially at right-angles to the axis of the pneumatic cylinder, in the extended state of the pneumatic cylinder, the cylinder surface of the second clamping element lying between the two cylinder surfaces of the first clamping element;

wherein one of the first and second clamping elements being arranged at the gripping collet body and the other being arranged at the piston of the pneumatic cylinder whereby the first and the second clamping elements being adapted to be clamped against each other by the pneumatic cylinder to grasp the thread.

2. The gripping collet of claim 1, wherein the first clamping element is arranged at the gripping collet body and the second clamping element is arranged at the piston.

3. The gripping collet of claim 1, wherein the pneumatic cylinder works against the force of a spring, so that the gripping collet is opened in normal state.

4. The gripping collet of claim 3, wherein the gripping collet comprises a control device for:

firstly controlling the supply of compressed gas to close the gripping collet and grasp the thread by moving the two clamping elements against each other;

secondly interrupting the supply of compressed gas so that the two clamping elements will be moved away from each other by force of the spring to open the gripping collet and release the thread; and thirdly setting the pressure of the compressed gas such that the spring force is essentially compensated for and the two clamping elements press with an at most low force against a thread arranged between them.

5. The gripping collet of claim 1, comprising a pin pointing in the direction of movement of the piston, which, together with the two clamping elements and the gripping collet body, surrounds a grasped thread on all sides.

* * * * *